US008899279B2

(12) United States Patent
Safronovs

(10) Patent No.: US 8,899,279 B2
(45) Date of Patent: Dec. 2, 2014

(54) METHOD FOR COMPRESSING GASEOUS FUEL FOR FUELLING VEHICLE AND DEVICE FOR IMPLEMENTATION THEREOF

(75) Inventor: Aleksejs Safronovs, Riga (LV)
(73) Assignee: Hygen Sia, Jelgava (LV)

( * ) Notice: Subject to any disclaimer, the term of this patent is extended or adjusted under 35 U.S.C. 154(b) by 1258 days.

(21) Appl. No.: 12/676,334
(22) PCT Filed: Sep. 9, 2008
(86) PCT No.: PCT/LV2008/000007
§ 371 (c)(1),
(2), (4) Date: Mar. 3, 2010
(87) PCT Pub. No.: WO2009/035311
PCT Pub. Date: Mar. 19, 2009
(65) Prior Publication Data
US 2010/0163135 A1 Jul. 1, 2010
(30) Foreign Application Priority Data
Sep. 12, 2007 (LV) ..... P-07-100
(51) Int. Cl.
*B65B 1/04* (2006.01)
*F04B 9/125* (2006.01)
*F17C 5/06* (2006.01)
*F04B 35/00* (2006.01)
(52) U.S. Cl.
CPC ..... *F04B 9/1253* (2013.01); *F17C 2270/0139* (2013.01); *F17C 2227/047* (2013.01); *F17C 2250/043* (2013.01); *F17C 2223/033* (2013.01); *F17C 2250/032* (2013.01); *F17C 2250/0408* (2013.01); *F17C 2221/033* (2013.01); *F17C 2225/0123* (2013.01); *F17C 2270/0178* (2013.01); *F17C 2227/0185* (2013.01); *F17C 2227/0192* (2013.01); *F17C 5/06* (2013.01); *F17C 2225/036* (2013.01); *F17C 2223/0123* (2013.01); *F17C 2223/035* (2013.01); *F04B 35/008* (2013.01)
USPC ..... 141/26; 141/5; 141/25; 141/95; 141/198
(58) Field of Classification Search
CPC ..... F17C 2227/0192
USPC ..... 141/4, 5, 12, 18, 21, 25, 26, 40, 47, 70, 141/77, 95, 199, 198
See application file for complete search history.

(56) References Cited

U.S. PATENT DOCUMENTS 2,478,321 A 8/1949 Robbins
4,304,527 A 12/1981 Jewell et al.
(Continued)

FOREIGN PATENT DOCUMENTS

RU 2 128 803 C1 4/1999
WO 03/019016 A 3/2003
WO 2004/070259 A 8/2004

OTHER PUBLICATIONS

International Search Report for International Application No. PCT/LV2008/000007 dated Feb. 9, 2009.
(Continued)

*Primary Examiner* — Timothy L Maust
(74) *Attorney, Agent, or Firm* — TransPacific Law Group; Pavel I. Pogodin

(57) ABSTRACT

This present invention relates to a preparation of gaseous fuel (natural gas for example) for its further transfer under pressure to fuel tank of a vehicle 22.

This object is achieved by a method for compressing gas by alternate transfer of gas into two vertically arranged compressing vessels 1 and 2, its compression and forcing into high-pressure vessels by filling the compressing vessels 1 and 2 with working fluid 30 under pressure by means of a hydraulic drive 5. A novelty of this method lies in that, each cycle of gas 29 compressing and its forcing out of the compressing vessels 1 and 2 is performed until these vessels are fully filled with the working fluid 30 contained in the compressing vessels 1 and 2 and alternately forced out of one compressing vessel into the other in response to a signal sent by fluid-level sensor 4.

6 Claims, 3 Drawing Sheets

(56) References Cited

U.S. PATENT DOCUMENTS

| | | | | | |
|---|---|---|---|---|---|
| 4,349,042 | A | * | 9/1982 | Shimizu | 137/39 |
| 4,379,434 | A | * | 4/1983 | Thordarson | 116/228 |
| 4,515,516 | A | | 5/1985 | Perrine et al. | |
| 4,547,132 | A | | 10/1985 | Uchida et al. | |
| 4,566,860 | A | | 1/1986 | Cowan | |
| 4,748,998 | A | * | 6/1988 | Farber et al. | 137/170.1 |
| 4,805,674 | A | | 2/1989 | Knowlton | |
| 5,073,090 | A | | 12/1991 | Cassidy | |
| 5,387,089 | A | | 2/1995 | Stogner et al. | |
| 5,454,408 | A | | 10/1995 | DiBella et al. | |
| 5,584,664 | A | | 12/1996 | Elliott et al. | |
| 5,603,360 | A | | 2/1997 | Teel | |
| 5,676,180 | A | * | 10/1997 | Teel | 141/18 |
| 5,863,186 | A | | 1/1999 | Green et al. | |
| 5,884,675 | A | * | 3/1999 | Krasnov | 141/18 |
| 6,202,707 | B1 | * | 3/2001 | Woodall et al. | 141/1 |
| 6,439,278 | B1 | | 8/2002 | Krasnov | |
| 6,652,243 | B2 | | 11/2003 | Krasnov | |
| 6,729,367 | B2 | * | 5/2004 | Peterson | 141/198 |
| 6,779,568 | B2 | * | 8/2004 | Borck | 141/67 |
| 2002/0038676 | A1 | | 4/2002 | Siegele et al. | |
| 2003/0175564 | A1 | * | 9/2003 | Mitlitsky et al. | 429/21 |

OTHER PUBLICATIONS

Ecofueler, www.eco-fueler.com, retrieved on Mar. 3, 2010.

* cited by examiner

METHOD FOR COMPRESSING GASEOUS FUEL FOR FUELLING VEHICLE AND DEVICE FOR IMPLEMENTATION THEREOF

BACKGROUND OF THE INVENTION

1. Field of the Invention

This present invention relates to a preparation of natural gas for its further transfer under pressure to a fuel tank of a vehicle, e.g., automobile, and may be used for providing individual gas-filling devices operated from a residential natural gas distribution network.

2. Description of the Related Art

Presently, there are used in this field gas-filling multistage compressors with both mechanical and hydraulic drives, which provide the compression of natural gas for its efficient application as a motor vehicle fuel. Complicated construction of compressors with mechanical drive, consumption of large amounts of power during their use, and generation of large amounts of heat, as well as high maintenance costs compensating a wear of movable parts of a compressor resulted in the development of compressors with hydraulic drives having some advantages over the compressors with mechanical drives.

It is known in the art a method for multistage compressing gas according to U.S. Pat. No. 5,863,186, wherein multistage gas compressing in series-connected compressing vessels of a compressor is performed by under-pressure supply of a hydraulic fluid thereinto, said hydraulic fluid being separated from the compressed gas by pistons moving in the vessels during operating cycles of the compressor. This method has found its application in gas-filling devices of ECOFUELER, including individual gas-filling appliances of HRA type (Home Refueling Appliance), operated from a residential low pressure gas network and from a standard residential electrical network (www.eco-fueler.com). The disadvantage of gas-filling devices operated according to this method is their high price limiting the broad use thereof in a private sector. The reason has to do with the need for high-technology constructional elements, mainly for precision hydraulic compressing vessels.

It is known in the art a method for hydraulic compression of gas for fueling a motor vehicle from mobile gas-filling appliances without a dividing piston between the gas and fluid (RU patent No. 2 128 803). The implementation of the method described in this patent provides the use of gas mainlines with gas pressure of 2.5 MPa (25 bar) and this method includes gas supply under said pressure into vertically arranged (because of the absence of the dividing piston) compressing vessels, compressing the gas and forcing it into accumulating vessels by an under-pressure supply of working fluid to the compressing vessels from an auxiliary vessel. To pump gas into the accumulating vessels there may be used two communicating compressing vessels, and gas accumulation in the accumulating vessel is performed by anti-phase alternate transfer from each compressing vessel of gas displaced from this vessel by fluid drawn from the other compressing vessel. The process of pumping the fluid from one vessel into the other is being performed by simultaneously filling the volume vacated by the fluid with gas from the gas mainline. The method described in RU patent No. 2 128 803 requires the observance of a condition that the ratio of the minimum volume of gas space in the working vessels to the volume between certain upper and lower levels of the fluid lies in the range from 1/20 to 1/25. This requirement is justified by "increase in operating and economical efficiency of one-stage gas compressing process" and is met by mounting of two—upper and lower— fluid-level sensors, so that once a certain upper level of the working fluid in a compressing vessel has been reached, a certain volume of non-displaced gas is left. Transfer of gas from accumulating vessels to User's vessels is performed by a displacement of fluid by gas with the sequential transfer of fluid from a previous vessel to the next ones. This method may be used in mobile gas-filling units providing large volumes of compressed gas by connection to a gas line with rather high pressure required for this method and having a power supply source of sufficient power (industrial electrical network). Moreover, because the above-mentioned condition provided by this method, when upon the termination of a compression cycle in a compressing vessel, a certain volume of compressed gas is left in its upper part, the effective volume of the further filling of a working vessel decreases due to significant volume expansion of this left non-displaced volume of the compressed gas. Therefore, the existence of such residual ("parasitic") volume of compressed gas left in the working vessel at the end of a compression cycle results in the so called "stretched spring effect" at the stage of filling the compressing vessel (residual compressed gas begins to increase many fold in volume).

To summarize briefly the known methods for compressing natural gas for fueling motor vehicles, it may be seen that the technical level of solutions in this field is limited by two predominant variants, of which the first variant provides fueling a vehicle from a residential gas low pressure network at high costs of hardware, whereas the second variant cannot be used as an individual means for fueling motor vehicles with gas.

SUMMARY OF THE INVENTION

The object of the present invention is to provide individual vehicle fueling from a residential low-pressure gas network using an individual gas-filling device cost-affordable for an average consumer.

This object is achieved by a method for compressing gas for fueling vehicles by alternate transfer of gas into two vertically arranged compressing vessels, its compression and forcing into high-pressure vessels by filling the compressing vessels with working fluid under pressure by means of a hydraulic drive. A novelty of this method lies in that, according to the present invention, each cycle of gas compressing and its forcing out of the compressing vessels is performed until these vessels are fully filled with the working fluid contained in the compressing vessels and alternately forced out of one compressing vessel into the other in response to a signal sent by a fluid-level sensor capable of detecting the full filling of the corresponding compressing vessel. To increase the efficiency of the method, i.e. to reduce the time required to fuel a motor vehicle, there may be provided the increase in gas pressure by its preliminary compression at the inlet of the compressing vessels. To reduce the time for fueling a vehicle, the device may be provided with an additional accumulating vessel, to which the fuel tank of the vehicle is connected during the fuelling.

Example 1 of the Implementation of the Method

One compressing vessel (standard high-pressure metal cylinder, 50 l capacity) is fully filled with gas from a source with the pressure of 2.0 KPa (about 200 mm $H_2O$) in a suction mode by pumping working fluid from it into the other vessel. Alternate pumping of the working fluid from one vessel to the other results in full displacement of gas into the fuel tank of a motor vehicle. When using a hydraulic drive with the delivery of 10 l/min the vehicle fuel tank of 50 l capacity (that corresponds to 10-11 l of gasoline equivalent) is filled up to the pressure of 20 MPa (200 bar) over a period of 17 hours.

Example 2 of the Implementation of the Method

To increase the operating efficiency of the gas-filling device according to the present invention there is used a precompressor that increases the pressure of the gas supplied from a residential network up to 2 bar at the inlet of the compressing vessel being filled. In this case, the time required to obtain the same amount of compressed gas reduces by half.

Example 3 of the Implementation of the Method

To enhance the convenience of the gas-filling device according to the present invention, there may be used an accumulating vessel, for example, a 50 l vessel, which may be previously filled (in the absence of a vehicle) with gas compressed up to 200 bar. In this case, the filling of the vehicle connected to the accumulating vessel may be carried out within 5 minutes by hydraulic displacement of the gas from this vessel.

BRIEF DESCRIPTION OF THE DRAWINGS

The examples of the implementation of the method may be illustrated by embodiments of the gas-filling device according to the present invention (FIG. 1-4) shown in drawings, in which.

DETAILED DESCRIPTION

Figure 1:
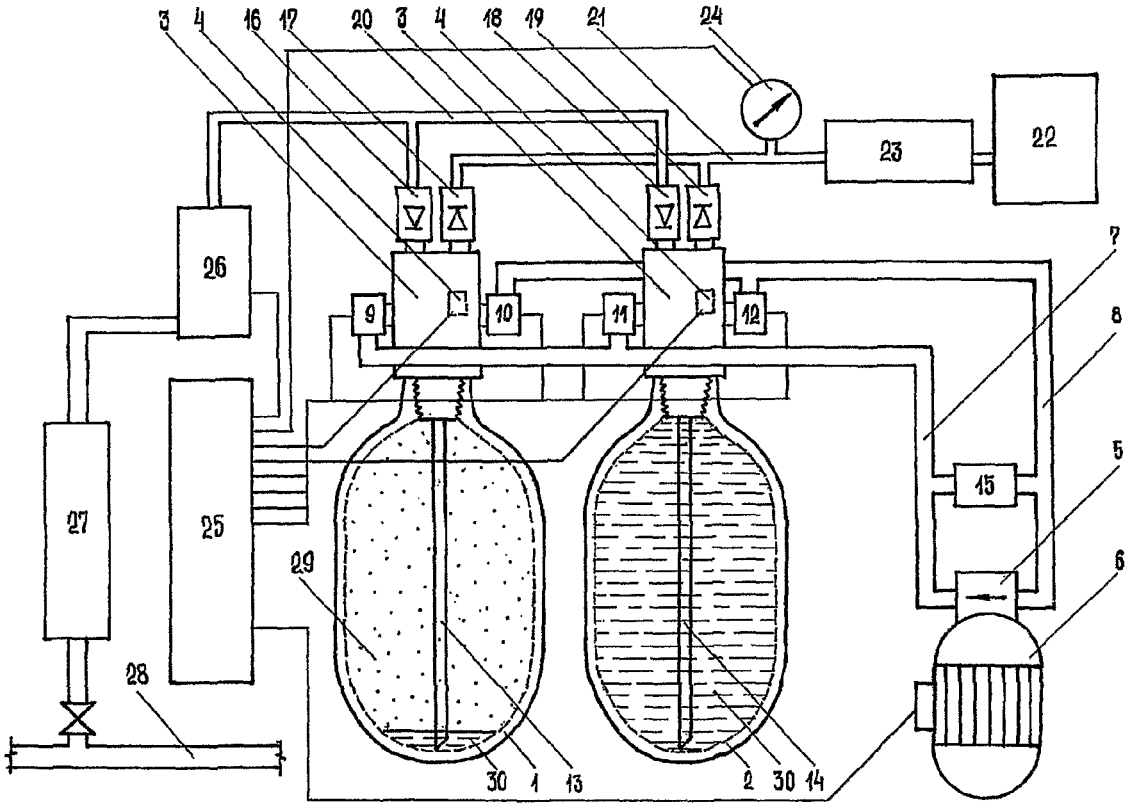
FIG. 1 shows the gas-filling device according to the present invention provided with a precompressor and compressing vessels, each having one outlet (one neck)

The gas-filling device illustrated in FIG. 1 comprises two compressing vessels (1) and (2), in the necks of which there are mounted shut-off devices (3) integrated with fluid-level sensors (4) capable of detecting the full filling of the compressing vessels (1) and (2) with working fluid. A hydraulic pump (5) with an electric drive (6) is provided with a high-pressure line (7) and low-pressure line (8), which are connected with the compressing vessels (1) and (2) through four shut-off electromagnetic valves (9), (10), (11), and (12) and tubes (13) and (14) inside the compressing vessels (1) and (2), and are connected with each other by means of a bypass valve (15). Working spaces of each compressing vessel (1) and (2) through the shut-off devices (3) and opposite connected one-way valves (16-17) and (18-19) from one side are connected through valves (16) and (18) to an inlet pipeline (20) for gas supply into compressing vessels (1) and (2), and from the other side they are connected through valves (17) and (19) with an outlet pipeline (21) for pumping the gas into the fuel tank of a vehicle (22) through a connector (23). An electric contact manometer (24), the output of which is connected to the input of an electronic control unit (25) is mounted on the outlet pipeline. The input of the electronic control unit (25) is connected also to outputs of the fluid-level sensors (4), its outputs being connected to four electromagnetic valves (9-12), the electric drive (6), and a pre-compressor (26), which is connected to a residential low-pressure gas line (28) through a filter-drier (27). In the initial condition, one of the compressing vessels (1) or (2) is filled with gas (29), and the other is fully filled with working fluid (30), a small amount of the working fluid (30) being contained also in the compressing vessel (1) with gas—to balance possible difference between actual working volumes of the compressing vessels (1) and (2) being used.

Figure 2:
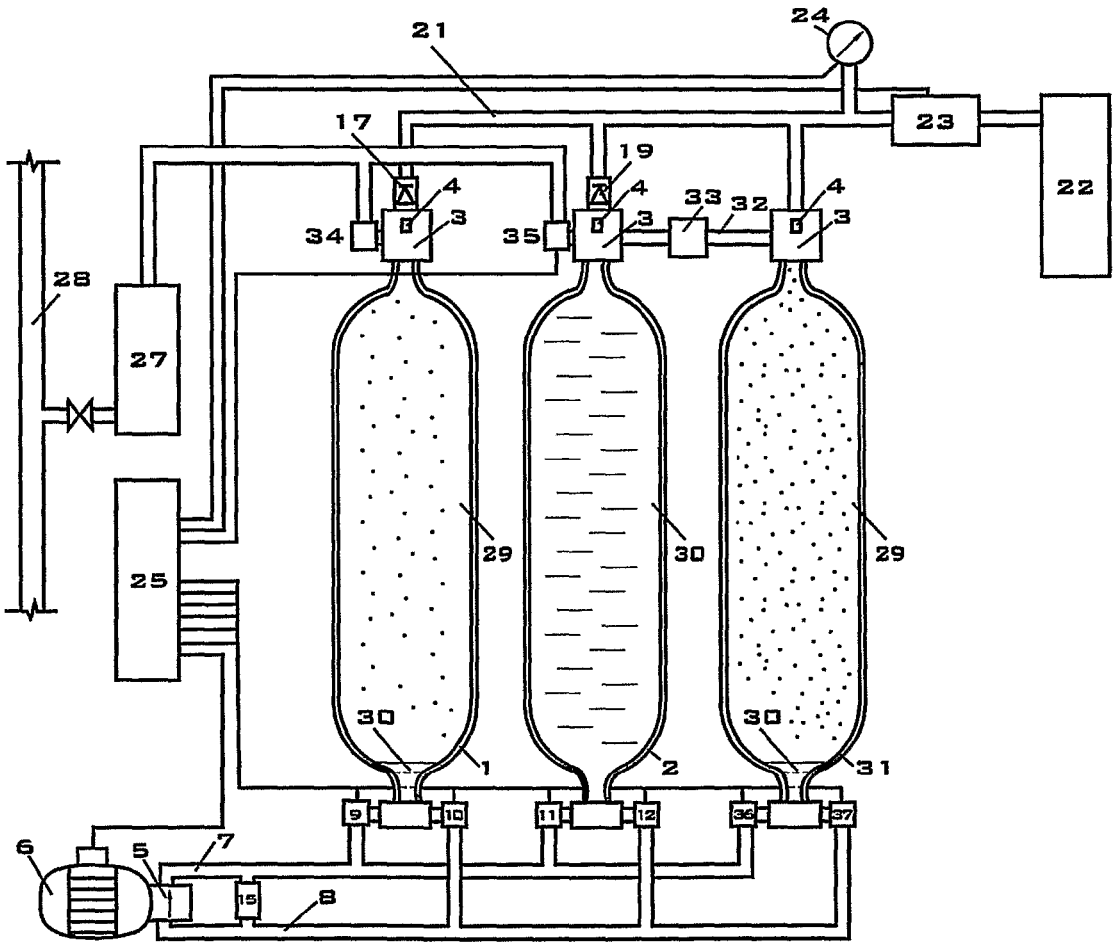
FIG. 2 shows the gas-filling device according to the present invention with an accumulating vessel and two compressing vessels, each having two outlets.

The gas-filling device according to the present invention illustrated in FIG. 2 with the accumulating vessel providing "fast" fueling of a vehicle without the pre-compressor, as compared to the gas-filling device shown in FIG. 1, is additionally provided with at least one accumulating vessel (31) and a drain tube (32) provided with a bypass valve (33).

Such device is shown in an embodiment when each of the compressing vessels (1) and (2) and the accumulating vessel (31) each has two necks—an upper neck and a lower neck. Gas and hydraulic mainlines in this case are staggered between upper (gas) and lower (hydraulic) necks of the compressing vessels (1) and (2) and the accumulating vessel (31). In the absence of a pre-compressor, the gas inlet one-way valves (16) and (18) (FIG. 1) of each of the compressing vessel (1) and (2) should be replaced with electromagnetic valves (34) and (35), because the pressure of the residential gas network is not high enough to overcome resistance of the one-way valves. The accumulating vessel (31) is provided with hydraulic electromagnetic valves (36) and (37).

The shut-off device (3) (FIG. 3) is intended to be used in the gas-filling device shown in FIG. 1, which is provided with compressing vessels (1) and (2), each of which having one neck in the upper part thereof. This shut-off device (3) has an inlet gas channel (38), an outlet gas channel (39), and a tube (40) connected by a T-shaped channel (41) with a high-pressure hydraulic line (7) and low-pressure hydraulic line (8) by electromagnetic valves (9-12). Between the outer wall of the tube (40) and a body (42) of the shut-off device (3) made of non-magnetic material there is a circular clearance (43), which is common for the inlet and outlet gas channels (38) and (39). In the outlet gas channel (39) there is a valve comprising of a movable closing element (44) provided with a magnetic insert (45) and a seat (46) in a fitting (47). A fluid-level sensor (4) capable of detecting the full filling of a compressing vessel with working fluid (30) placed at the outer side of the body (42) of the shut-off device (3) and the magnetic insert (45) are located at the same level in the lower position of the movable closing element (44).

Figure 3:
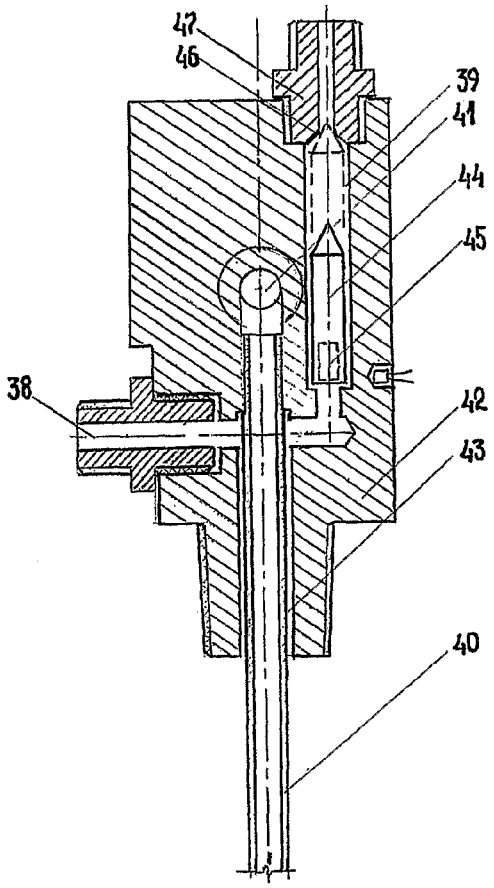
FIG. 3 shows a shut-off device integrated with a fluid-level sensor capable of detecting a limit level of the working fluid used for the gas-filling device shown in FIG. 1.
Figure 4:
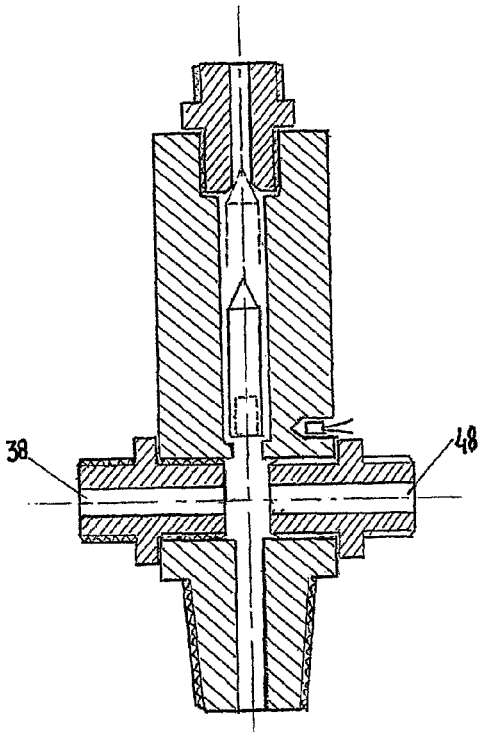
FIG. 4 shows a shut-off device integrated with a fluid-level sensor capable of detecting a limit level of the working fluid used for the gas-filling device shown in FIG. 2.

A shut-off device (3) (FIG. 4) of the gas-filling device shown in FIG. 2 is similar to the shutoff device (3) shown in FIG. 3, which does not have the tube (40) and the T-shaped channel (41), but is additionally provided with a channel (48) (only in the shut-off device (3) for the compressing vessel (2)) to be connected to the drain tube (32).

The gas-filling device operates as follows. In the initial condition shown in FIG. 1, the compressing vessel (1) apart from a small amount of the working fluid is filled with gas from the residential low-pressure gas line (28) by means of the pre-compressor (26). The compressing vessel (2) is fully filled with the working fluid (30) for hydraulic systems. When starting the gas-filling device to fuel the vehicle (22) connected to the device through the connector (23), the electronic control unit (25), which runs an operating program, is activated, as a result of which the pre-compressor (26) and the electric drive (6) of the hydraulic pump (5) are simultaneously switched on, and the electromagnetic valves (9-12)

are brought into a condition wherein the compressing vessel (1) is connected, through the open valve (9), to the high-pressure line (7), and the compressing vessel (2), through the open valve (12), is connected to the low-pressure line (8). During the operation of the hydraulic pump (5), the working fluid from the compressing vessel (2) through the tube (14), T-shaped channel (41) of the shut-off device (3) (FIG. 3), the open electromagnetic valve (12), the low-pressure line (8), the hydraulic pump (5), the high-pressure line (7), the open electromagnetic valve (9), and the tube (13) is pumped into the compressing vessel (1), from which the gas through a circular clearance (43) of the shut-off device (3), a clearance between the movable closing element (44) and walls of the outlet gas channel (39) of the shut-off device (3) (FIG. 3), through the outlet pipeline (21), and the connector (23) is displaced into the fuel tank of the vehicle (22). This process is accompanied by filling a vacated volume of the compressing vessel (2) with the gas coming from the compressor (26) through the gas-supply inlet pipeline (20) through the one-way valve (18) into the inlet gas channel (38) of the shut-off device (3) (FIG. 3). Once the working fluid (30) has reached the lower edge of the closing element (44), said element moves upward from the lower position and closes by its tapered portion, the seat (46) of the valve in the fitting (47). Simultaneously, the magnetic insert (45) leaves the area of the fluid-level sensor (4) of the compressing vessel (1), said sensor sends a signal to the electronic control unit (25) in order to change the hydraulic flow into a reverse mode, in which the electromagnetic valves (9) and (12) are closed, and the valves (10) and (11) are opened, and the working fluid (30) from the completely filled compressing vessel (1) begins to enter the compressing vessel (2). The process of forcing the gas (29) out of the compressing vessel (2) and of filling the compressing vessel (1) with the gas is similar to the process described above. Repetition of cycles of filling-displacement of gas (29) and pumping of the working fluid (30) results in gradual gas pressure increase in the outlet pipeline (21) (filling the fuel tank of the vehicle (22)). The pressure in the outlet pipeline (21) is monitored by means of the electric contact manometer (24). Once target pressure has been reached in the outlet pipeline (21), the manometer (24) sends a signal to the electronic control unit (25) and then, on response of the fluid-level sensor (4) of the compressing vessel (1) or (2) with the working fluid (30), the electronic control unit (25) issues a command to stop the operation of the gas-filling device—in the initial condition prepared to begin the next filling cycle.

When the claimed method is implemented by means of the above-described device with the hydraulic pump (5) with delivery of 10 l/min and the pre-compressor (26) with delivery of 40 l/min, the filling of a 50-liter fuel tank of the vehicle up to the pressure of 200 bar is carried out over a period of 5-5.5 hours duration, which allows the vehicle to be re-fuelled, for example, at night. This time depends mainly upon the pre-compressor delivery.

The embodiment of the gas-filling device according to the method of invention allows the reduction of time required for complete filling of a fuel tank of a vehicle even with the pre-compressor excluded from the gas-filling system. This may be provided by incorporating an accumulating vessel into the gas-filling device introducing the former into the unified gas and hydraulic systems of the above-described device. Below the operation of said device is described in an embodiment wherein high-pressure standard cylinders with two outlet necks at the end parts thereof are used as compressing and accumulating vessels (FIG. 2).

In this embodiment of the gas-filling device of the present invention, gas and hydraulic main pipelines are separated: the gas main pipeline is connected to the upper necks of the vessels and the hydraulic pipeline is connected to the lower necks thereof.

The device operates as follows.

In the initial condition, gas and working fluid are present in the both compressing vessels (1) and (2) similar to the initial condition described in the first embodiment of the method described above, the compressing vessel (1) being filled with gas (29) (with a small amount of working fluid in its lower part), and the compressing vessel (2) being filled with working fluid (30). In the accumulating vessel (31) there is also a certain amount of working fluid that is necessary to compensate possible manufacturer's tolerance for actual volume of gas cylinders.

The operation of the gas-filling device is carried out in two stages: the stage of filling the accumulating vessel (31) and the stage of transfer of accumulated compressed gas from the accumulating vessel (31) into the fuel tank of the vehicle (22).

The filling of the accumulating vessel (31) (the first stage of the process) is carried out in the following sequence. When starting the gas-filling device, the electronic control unit (25), which runs an operating program, is activated, the electrical drive (6) of the hydraulic pump (5) switches on and the electromagnetic valve (35) opens simultaneously, the electromagnetic valves (9-12) are brought to the condition wherein the compressing vessel (1) is connected to the high-pressure line (7) through the opened valve (9), and the compressing vessel (2) is connected to the low-pressure line (8) through the opened valve (12). During the operation of the hydraulic pump (5), the working fluid (30) from the lower neck of the compressing vessel (2) through the open valve (12), the low-pressure line (8), the hydraulic pump (5), the high pressure line (7), the open electromagnetic valve (9), and the lower neck of the compressing vessel (1) is pumped into the compressing vessel (1), from which the gas (29) through the outlet gas channel (39), the clearance between the movable closing element (44) and walls of the outlet gas channel (39) of the shut-off device (3) (FIG. 4), the one-way valve (17), and the outlet pipeline (21) is displaced into the accumulating vessel (31). This process is accompanied by filling a vacated volume of the compressing vessel (2) with the gas coming from the low-pressure gas pipeline (28) through the open electromagnetic valve (35). Once the working fluid (30) has reached the lower edge of the movable closing element (44), said element is displaced upwards from its lower position and closes by its tapered portion the seat (46) of the valve in the fitting (47). At the same time, the magnetic insert (45) leaves the area of the fluid-level sensor (4) of the compressing vessel (1), which sends a signal to the electronic control device (25) to change the hydraulic flow into a reverse mode, in which the electromagnetic valves (9) and (12) are closed, and the valves (10) and (11) are opened and the working fluid from the fully filled compressing vessel (1) starts filling the compressing vessel (2). The process of displacement of the gas from the compressing vessel (2) and of filling the compressing vessel (1) is similar to the process described above. The repetition of gas filling-displacement and fluid pumping cycles results in gradual increase of gas pressure in the outlet pipeline (21) (filling the accumulating vessel (31)). The pressure in the outlet pipeline (21) is monitored by means of the electric contact manometer (24). Once a target pressure in the outlet pipeline (21) has been reached, the manometer (24) sends a signal to the electronic control unit (25), and then, on response of the fluid-level sensor (4) of the compressing vessel (2) full with the working fluid, the electronic control unit (25) issues a command to stop the operation of the gas-filling device—in the initial condition prepared to begin the filling of the fuel tank of the vehicle (22).

The transfer of accumulated compress gas from the accumulating vessel (31) into the fuel tank of the vehicle (22) (the second stage of the process) is performed upon the connection of the fuel tank of the vehicle (22) through the connector (23) to the accumulating vessel (31) by activating a filling program at the electronic control unit (25), wherein the electromagnetic valve of the connector (23) connecting the outlet pipeline (21) to the fuel tank of the vehicle (22) is opened with simultaneously starting the electric drive (6) of the hydraulic pump (5) and setting the electromagnetic valves into the position providing the transfer of the working fluid (30) from the compressing vessel (2) into the accumulating vessel (31), which results in that the gas from the accumulating vessel (31) is fully forced into the fuel tank of the vehicle (22) up to response of the fluid-level sensor (4) of the accumulating vessel (31) signaling of the complete filling of the latter. At the moment of the response of the fluid-level sensor (4) of the accumulating vessel (31), the hydraulic system is switched into a reverse mode, in which the working fluid from the accumulating vessel (31) is returned into the compressing vessel (2). The volume of the accumulating vessel (31) vacated from the working fluid is then filled with expanding gas, which is present under a high pressure in the drain tube (32). The system switches to the initial condition prepared for further filling of the accumulating vessel (31). In case when the fuel tank of the vehicle (22) has been completely filled up to the working pressure of 200 bar, and some non-displaced gas is left in the accumulating vessel (31), the electric contact manometer (24) sends a signal to the electronic control unit (25), from which a signal to close the electromagnetic valve in the connector (23) is sent. The filling of the accumulating vessel (31) with the working fluid (30) continues but the gas, through the drain tube (32) and through the bypass valve (33) opened by gas pressure, enters not the fuel tank of the vehicle (22) but the compressing vessel (2) up to the moment of full filling of the accumulating vessel (31) with the working fluid, response of the fluid-level sensor (4) and full forcing the gas out of the accumulating vessel (31) into the compressing vessel (2). Upon the response of the fluid-level sensor (4) signaling of full filling of the accumulating vessel (31), the hydraulic system, by the signal from the electronic control unit (25), is brought into the condition of returning the working fluid from the accumulating vessel (31) into the compressing vessel (2), from which the gas is forced into the accumulating vessel (31) through the outlet pipeline (21). The system is brought into the initial condition prepared to begin filling the accumulating vessel (31).

The application of this embodiment of the gas-filling device for the implementation of the method of invention allows the device to be prepared for "fast" fueling of a vehicle with highly compressed gas from the accumulating vessel (31). The rate of filling the fuel tank in this case depends upon the hydraulic pump delivery, and said filling may be performed within several minutes necessary for full displacement of the gas accumulated in the accumulating vessel irrespective pressure ratios of the fuel tank and the accumulating vessel (31).

The method of invention together with the embodiments of the gas-filling device allows the autonomous (individual) fueling of a private vehicle in a mode convenient for the owner. The present invention thus provides possibility of fueling vehicles from a source of low pressure gaseous fuel, for example, residential natural gas or biomethane, by means of a gas-filling unit, the construction of which is based on the use of mass production components without the use of expensive precision elements.

The invention claimed is:

1. A method for compressing a gaseous fuel for fueling a vehicle comprising alternately supplying gas into two vertically arranged compressing vessels comprising a first compressing vessel and a second compressing vessel (1 and 2), each having one neck in the upper part thereof, further compressing the gas and forcing the gas out of said vessels and into a fuel tank of the vehicle by alternately filling the compressing vessels with a working fluid under pressure wherein each cycle comprising alternate filling of the compressing vessels is carried out until said vessels are completely filled with working fluid and the working fluid is alternately pumped from one compressing vessel into the other, wherein, during each cycle, the working fluid travels directly from the first compressing vessel into the second compressing vessel and returns from the second compressing vessel directly into the first compressing vessel without traveling through any intermediate vessels such that said travel of the working fluid is performed until its flow reaches the lower edge of a movable closing element of a shut-off device mounted in said upper neck of the compressing vessel, and displaces said movable closing element in an outlet gas channel of said shut-off device upwards from its lower position, thus closing the seat of a valve of an outlet pipeline for pumping the gas into fuel tank of the vehicle with a tapered portion of said movable closing element before said working fluid reaches said seat of the valve of said outlet pipeline for pumping the gas into fuel tank of the vehicle, said upward movement of the movable closing element activating a fluid-level sensor placed at the outer side of the body of the shut-off device, which generates a Signal for a control unit to change the direction of pumping the working fluid to reverse mode for a new similar cycle of pumping the working fluid from the compressing vessel (2 or 1) which is completely filled therewith to the other compressing vessel (1 or 2) which is filled with gas and working fluid, where the amount of said working fluid is enough for compensation of the possible difference of inner volumes of compressing vessels (1 and 2).

2. A gas-filling device for fueling a vehicle with a gaseous fuel comprising two compressing vessels (1 and 2) connected through one-way valves to an inlet pipeline for gas supply and an outlet pipeline for pumping the gas into the fuel tank of the vehicle and communicating with each other through a high-pressure hydraulic line and a low-pressure hydraulic line, a hydraulic pump, configured to pump the working fluid alternately from one compressing vessel (1 or 2) into the other compressing vessel (2 or 1) and an electric control unit, the hydraulic pipeline being connected to the hydraulic pump, the outlet pipeline for pumping the gas comprising a vehicle fueling connector, wherein each compressing vessel (1 and 2) comprises a shut-off device integrated with a fluid-level sensor, the latter being placed on the outer side of the body of said shut-off device, said body of the shut-off device being made of a non-magnetic material, said shut-off device being mounted in the neck of the respective compressing vessel (1 and 2), the shut-off device having a movable closing element which has a tapered upper portion, and said movable closing element is placed in an outlet as channel of the shut-off device with a clearance between it and the walls of said outlet gas channel, said movable closing element being capable of staying in a lower position when the gas flows through the clearance and moving upwards within said channel by the action of the flow of working fluid and closing the gas channel, said movable closing element having a magnetic insert, said fluid-level sensor and said magnetic insert being located at the same level in said lower position of said movable closing element, and said magnetic insert being located out of the area of the fluid level sensor in the upper positions of said movable closing element.

3. The gas-filling device according to claim 2, further comprising an accumulating vessel connected to the gas pipeline and to the hydraulic pipeline interconnecting the two compressing vessels, the accumulating vessel comprising a shut-off device, mounted in the neck of said accumulating vessel in the same manner as the shut-off devices of the compressing vessels, the shut-off device of the accumulating vessel being connected by a drain tube and a bypass valve to the shut-off device of one of the two compressing vessels for draining the gas from said accumulating vessel to the compressing vessel in case when the fuel tank of the vehicle is full, but there is still some gas in the accumulating vessel in order to achieve completely forcing the gas out of said accumulating vessel by means of completely filling said accumulating vessel with working fluid until the activation of the fluid-level sensor of said shut-off device.

4. The method according to claim 1, wherein the gas from the two compressing vessels is forced into an accumulating vessel, and further out of the accumulating vessel and the accumulated gas during the fueling of the vehicle is completely forced out of said accumulating vessel into the fuel tank of the vehicle until the accumulating vessel is completely filled with the working fluid, in case when the fuel tank of the vehicle has been completely filled up to the working pressure, and some non-displaced gas is left in the accumulating vessel the filling of accumulating vessel with the working fluid continues but the gas, through the drain tube and through the bypass valve opened by gas pressure, enters not the fuel tank of the vehicle, but the compressing vessel up to the moment of full filling of the accumulating vessel with working fluid response of the fluid-level sensor and full forcing the gas out of the accumulating vessel into the compressor vessel.

5. The gas-filling device according to claim 2, wherein the two compressing vessels each comprise two necks, upper and lower, the upper necks being connected to the gas pipeline and the lower necks being connected to the hydraulic pipeline.

6. The gas-filling device according to claim 3, wherein the two compressing vessels and the accumulating vessel each comprise two necks, upper and lower, the upper necks being connected to the gas pipeline and the lower necks being connected to the hydraulic pipeline.

* * * * *